US012156579B2

(12) United States Patent
Del Din et al.

(10) Patent No.: US 12,156,579 B2
(45) Date of Patent: Dec. 3, 2024

(54) CONTAINER WITH INTERNAL RECEPTACLE SUSPENDED IN AN EXTERNAL RECEPTACLE AND METHOD FOR ASSEMBLING THE CONTAINER USING AN INTERFACE WITH TWO FLANGES

(71) Applicant: POCHET DU COURVAL, Clichy (FR)

(72) Inventors: Antoine Del Din, Yaucourt-Bussus (FR); Frédéric Jouan, Moriers (FR)

(73) Assignee: POCHET DU COURVAL, Clichy (FR)

( * ) Notice: Subject to any disclaimer, the term of this patent is extended or adjusted under 35 U.S.C. 154(b) by 214 days.

(21) Appl. No.: 17/845,348

(22) Filed: Jun. 21, 2022

(65) Prior Publication Data

US 2022/0312935 A1 Oct. 6, 2022

Related U.S. Application Data

(63) Continuation-in-part of application No. PCT/FR2020/052484, filed on Dec. 17, 2020.

(30) Foreign Application Priority Data

Dec. 20, 2019 (FR) ..... 19 15231

(51) Int. Cl.
*A45D 40/00* (2006.01)
*A45D 34/00* (2006.01)

(52) U.S. Cl.
CPC ..... *A45D 40/0068* (2013.01); *A45D 34/00* (2013.01); *A45D 2034/005* (2013.01)

(58) Field of Classification Search
CPC ..... A45D 2034/005; A45D 34/00; A45D 40/0068; A45D 40/18; B65D 1/10; B65D 77/0493

(Continued)

(56) References Cited

U.S. PATENT DOCUMENTS 3,550,803 A 12/1970 Pelli
9,944,444 B2 4/2018 Presche

FOREIGN PATENT DOCUMENTS

FR 1.573.885 7/1969
FR 2 878 835 6/2006

(Continued)

OTHER PUBLICATIONS

International Search Report for PCT/FR2020/052484 dated Feb. 25, 2021, 5 pages (with English Translation).

*Primary Examiner* — Stephen J Castellano
*Assistant Examiner* — Madison L Poos
(74) *Attorney, Agent, or Firm* — NIXON & VANDERHYE

(57) ABSTRACT

Disclosed is a fluid product dispensing assembly including: an external container equipped with an opening, the container including an internal wall defining an internal space; an internal lining which is disposed in the internal space; and a dispensing member, such as a pump, which is used to dispense the fluid product. The assembly also includes a barrier envelope which is intended to contain the fluid product and which is disposed inside the aforementioned internal lining, such that the fluid product does not come into contact with the internal lining. The container is made from a transparent or translucent material, such as glass, such that the internal lining is visible through the container. The internal lining is substantially opaque so as to mask the above-mentioned barrier envelope at least partially and preferably completely.

20 Claims, 5 Drawing Sheets

(58) Field of Classification Search
USPC ..... 215/6
See application file for complete search history.

(56) References Cited

FOREIGN PATENT DOCUMENTS

| | | |
|---|---|---|
| FR | 3 056 087 | 3/2018 |
| FR | 3 060 271 | 6/2018 |
| FR | 3 067 328 | 12/2018 |

CONTAINER WITH INTERNAL RECEPTACLE SUSPENDED IN AN EXTERNAL RECEPTACLE AND METHOD FOR ASSEMBLING THE CONTAINER USING AN INTERFACE WITH TWO FLANGES

CROSS-REFERENCE TO RELATED APPLICATIONS

This application is the Continuation-in-Part of International Application No. PCT/FR2020/052484 filed Dec. 17, 2020 which designated the U.S. and claims priority to French Patent Application No. 19 15231 filed Dec. 20, 2019, the entire contents of each of which are hereby incorporated by reference.

BACKGROUND OF THE INVENTION

Field of the Invention

This invention relates to the field of packaging containers enabling good preservation of a product, in particular a cosmetic or perfumery product, and more particularly the field of containers made of inert material such as glass.

The invention relates here to a container which has an internal receptacle used to directly contain the product (for example cosmetic or a similar type), and an external receptacle typically made of glass which allows housing the internal receptacle inside it, this external receptacle combining the functions of decoratively covering the container and of receiving a closure system that can be used to close off the container after the consumer has removed product for the first time. The invention also relates to a method for assembling the container by using an interface with two flanges which makes it possible to maintain space between the internal receptacle and external receptacle.

Description of the Related Art

As illustrated for example by document FR 1573885, It has long been known to use transparent external coverings, in particular made of glass, in cosmetic product packaging devices, while receiving the product within an internal receptacle, typically made of plastic. However, the use of a plastic internal receptacle can pose problems of chemical compatibility with the product to be packaged. Polyethylene and polypropylene are then the only choices for producing such an internal receptacle. There is a need to limit the use of disposable plastic receptacles, however.

In addition, it would be of particular interest to be able to easily refill the container with product, typically without throwing away the plastic receptacle and while minimizing the amount of plastic for creating the interface between receptacles. A non-deformable rigid material, typically such as glass, would be preferable because it is more easily reusable (and easily recyclable in the case of glass).

Interfaces are known, from document FR 2878835 A1, for assembling an internal receptacle which may be made of glass with a covering receptacle internally covered with decorations, in order to obtain an assembly for the dispensing of fluid product which allows refills. However, the type of assembly shown in that document is relatively complex, which limits its application and reduces the possibilities for aesthetic effect; full advantage is not taken of the properties and performance of glass.

In the field of glass bottles or receptacles, typically for applications far removed from the field of cosmetics, rubber/elastomer seals are sometimes used (compressible seals) to enable a reservoir to be mounted inside the outer glass container, as is shown for example in document U.S. Pat. No. 9,944,444 B2. A compressible seal of this type allows coming into direct contact with the glass wall of the external receptacle.

However, the use of rubber or elastomer is not very suitable for supporting an internal reservoir, particularly if one wishes to package a relatively large amount of product when the internal receptacle is to be suspended. In addition, elastomer seals of this type are tricky to recycle (thermosetting plastics having crosslinks). It should also be noted that the use of polyethylene or polypropylene or similar plastic is clearly unsuitable as a substitute for an elastomer seal/insert with pressing contact, given the tendency of these polyolefins to crack (a phenomenon known as stress cracking). There is therefore a need for a robust container, obtained by an assembly solution optimized for the properties and performance of glass.

SUMMARY OF THE INVENTION

In order to improve the situation, a container is proposed for holding a product, typically cosmetic, formed by mounting, along a longitudinal axis, an internal receptacle within an external receptacle (receptacle which may provide the decorative covering), preferably transparent, by means of a support flange, the container comprising:

- the internal receptacle formed as one piece (of mineral material, preferably chemically inert) and delimiting a volume for receiving the product, the internal receptacle extending longitudinally with a side wall between a bottom and an upper face that is provided with an opening bordered by an annular upper end of the internal receptacle;
- the external receptacle including a part made of non-deformable mineral material such as glass, preferably transparent, suitable for internally housing the internal receptacle within an interior volume accessible via a longitudinal opening; and
- a retaining interface for immobilizing the internal receptacle, the interface comprising a support flange which is annular and integral with the external receptacle, the support flange having an upper contact face suitable for axially supporting, preferably selectively, the annular upper end so as to maintain space between the internal receptacle and external receptacle; in the knowledge that the support flange is a lower flange of the interface, this interface also comprising an upper flange distinct from the support flange, the external receptacle having an upper end provided with attachment means for rendering the support flange integral with the upper end in an assembled configuration, in which:
- the lower and upper flanges are capable of sandwiching at least one engaging edge provided at the annular upper end in order to ensure the retention and immobilization of the internal receptacle; and
- the support flange is fixed in a position of axial overlap above the upper end, and allows detachable attachment of the upper flange in an engagement area that is offset radially outwards relative to an axial area of contact between the at least one engaging edge and the upper contact face.

It is understood that the internal receptacle may be a refill. It is held suspended in a predetermined axial position relative to the external receptacle. Typically, the upper flange surrounds the lower flange. The attachment means may allow removable attachment of the support flange on the upper end of the external receptacle, to facilitate recycling the external receptacle. The interior of the internal receptacle remains accessible in the mounted state of the lower flange and of the upper flange kept superimposed by its attachment around the lower flange, due to the through-openings respectively defined by these flanges. A simple annular shape may be preferred for each of the flanges.

Attachment of the upper flange may be achieved by engaging an inner face of a side wall element included in the upper flange against the support flange within an annular region (corresponding to the engagement area) that is offset radially outwards relative to the axial area of contact on the upper contact face.

The upper flange may have any suitable continuous or discontinuous part (possibly slotted) for pressing the internal receptacle downwardly, directly or via a collar or similar edge part provided around/secured to the annular upper end of the internal receptacle.

These arrangements allow the internal receptacle to be held in place without resorting to an area for attachment by clamping on the outer periphery of the internal receptacle. This makes it possible to simplify the design of the internal receptacle and of the lower flange.

In the invention, it is possible to provide a container which can be aesthetically pleasing and capable of effectively preserving the contents while facilitating assembly. It also allows great flexibility in the final assembly, as the product may or may not already be present and sealed within the internal receptacle before insertion into the external receptacle.

Flexibility is also obtained for the choice of material or materials of the interface formed as a two-part retaining ring. Indeed, stresses can be exerted on this material around the product storage and sampling area. The attachment to the external receptacle can also be robust, while adapting to the rigidity of glass, for example by forming elastically deformable engagement portions delimited between slots. The inner face of the external receptacle can then be completely spaced apart from the internal receptacle and also from the retaining interface, which makes it possible to take advantage of the performance of glass or a similar noble material forming the external receptacle.

In some embodiments, the internal receptacle has an upper flange ring to form its annular upper end, this upper flange ring extending around the opening (which is preferably the only opening of the internal receptacle). It is understood that the coupling annular support flange can form a seat for the flange ring to rest against. An assembly with no mechanical attachment of the internal receptacle on the lower flange is a preferred option, to facilitate extraction.

The upper flange may have an inner centering edge, which allows centering the internal receptacle, for example by guiding, with a centering effect, an upper protruding annular projection of the internal receptacle. The radial clearance or spacing between the upper projection of the internal receptacle and the upper flange is typically less than the radial clearance or spacing provided between the side wall of the internal receptacle and the annular inner edge of the lower flange (support flange). The use of a lower flange still present after selective removal of the upper flange makes it possible in particular to avoid creating friction contact between the internal receptacle and the lower flange, and makes it very easy to remove the internal receptacle which is not radially clamped by any retaining piece.

According to one feature, the longitudinal opening is delimited by a neck of the external receptacle, the support flange being a part entirely external to the interior volume of the external receptacle and which may consist essentially of:

- a flat portion (i.e. substantially flat) covering the neck axially; and
- an annular side portion for attachment to said neck.

More generally, it is understood that it is permitted to dispense with an inner portion radially interposed between the respective side faces of the internal receptacle and the neck (or similar end part) of the external receptacle, which can minimize the force needed to extract a part made of breakable glass from the external receptacle, in the absence of contact between the internal receptacle and the support flange.

According to one feature, the annular side portion extends downwards from an outer periphery of the flat portion and has at least one elastically deformable portion which is:

- suitable for engaging with an annular peripheral attachment region formed on the neck and locking a coupling state of the support flange on the external receptacle, and
- optionally delimited by slots or recesses in the thickness of the annular side portion.

It is understood that the retaining ring type of interface is well suited for immobilizing the receptacles (internal and external) relative to each other, without undergoing significant radial compression. In the lower flange, radial movement is permitted only at the deformable portions, with the knowledge that the complementary portions of the annular side portion are preferably more rigid in order to allow friction and/or to form reliefs or threads for engaging a skirt of the upper flange (this makes it possible to lock a coupling state without damaging the material).

The retaining interface, the internal receptacle, and the external receptacle form an assembly opened from above for access to the interior of the internal receptacle. It is understood that the retaining interface is designed to remain integral with the external receptacle It is understood that here the expression "annular side portion" is to be understood in a more expansive meaning, in the knowledge that relatively wide indentations or narrow slots may be provided to separate complementary wall portions, in options where the side portion is not continuous (no continuously circular shape for example).

The internal receptacle may optionally have already been sealed, before or after the first coupling, by means of a membrane seal adhering to an upper edge of the internal receptacle and/or to the top of an outer portion of an annular insert or annular collar, which is secured to the internal receptacle.

The external receptacle is advantageously suitable for storing and retaining the internal receptacle while serving as an outer decorative covering, with the possibility where appropriate of replacing only the internal receptacle after the contents have been consumed. Furthermore, it is also possible to recycle and reuse the assembly formed by the insert and the internal receptacle, for example if the consumer is motivated financially or in any other manner to return this assembly in order to refill the internal receptacle with product.

In some embodiments of the container, one or more of the following features may be used:

- the attachment of the upper flange on the lower flange in order to form the retaining interface has the effect of causing the engaging edge to transition from an unclamped position (and not retained by the support flange) in which this engaging edge is resting against the support flange, in the absence of the upper flange, to a position clamped axially against the lower flange, by the clamping action of the upper flange.

the upper end of the container is annular in shape and provided with an opening forming an outlet through the top of the volume for receiving product.

the volume for receiving product is accessible through the upper flange, via the through-opening in this upper flange (the upper flange forming a sort of annular lock whose presence is sufficient to block axial movement of the internal receptacle, the removal of this lock typically sufficient to eliminate the axial blocking of the internal receptacle).

a same material of the upper flange is in contact with the engaging edge and with the external receptacle.

the upper flange has an inner face composed of a same material.

the upper flange consists of one piece, which is preferably annular.

the internal receptacle is made of one among a metal material (for example aluminum, an aluminum alloy, steel), a glass, a ceramic, a porcelain.

the support flange is assembled by rotation, preferably by screwing or by a bayonet-type attachment.

the upper end is provided with an annular peripheral attachment region which is continuous or discontinuous, configured for engaging an internal engagement face of the support flange with said attachment region and thus obtaining a coupling state for immobilizing the support flange on the external receptacle.

the neck that is part of the external receptacle has an outer side face provided with at least two recesses to allow bayonet-type attachment of the flange.

the external receptacle is of the type with a single opening, which is an upper opening.

the rotational coupling of the support flange can facilitate some disassembly steps (which is advantageous for recycling when the external receptacle is made of glass).

the support flange comprises rotation-locking means capable of being attached to the annular peripheral attachment region, for an effect of preventing rotation of the support flange around the external receptacle, in order to lock the coupling state.

the rotation-locking means are each formed in an inner engagement face (that is part of the lower support flange), in the at least one elastically deformable portion.

each elastically deformable portion is separated from the rest of the annular side portion by slots.

the support flange (lower flange supporting the internal receptacle by the bottom) has external rotation-locking members capable of being attached on the upper flange in a locking configuration without interfering with the coupling state.

the external locking members are formed in one or more regions of the annular side portion which are distinct from the elastically deformable portion or portions.

the external locking members are configured for maintaining a low axial position of the upper flange (clamping position) while making it possible to clamp axially the at least one engaging edge between the lower and upper flanges by an action of relative rotation between the lower and upper flanges.

each of the elastically deformable portions may be capable of movement by displacement, preferably around a hinge area formed between the pair of slots.

the external locking members are second rotation-locking means which allow locking by reversibly clamping or snap-fitting to the upper flange, without modifying the rotationally locked state between the lower support flange and the external receptacle (the ring portion of the flange carrying the first locking means).

the upper flange forms a part that is selectively detachable from the support flange and defines a centering edge, such centering typically making it possible to finalize the distanced position of the internal receptacle relative to the external receptacle.

the support flange is kept integral with the external receptacle by an attachment selected among a screwing or a bayonet-type attachment, whereby the internal receptacle forms a refill that is extractable without radial friction against the retaining interface.

a centering from above may be implemented by the upper flange for precise positioning of the internal receptacle, so that the support flange does not have to perform such a function (this makes it possible to increase the radial clearance and to ensure that extraction of the internal receptacle will be easy after having previously removed the upper flange).

the internal receptacle has a longitudinal axis and an upper flange ring for forming the at least one engaging edge, the upper flange ring extending around the opening of the internal receptacle which is preferably the only opening of the internal receptacle, the opening preferably being wider than the bottom.

the support flange projects radially inwards relative to an annular inner edge of the upper end, in order to reduce the cross-sectional area defined by the longitudinal opening of the external receptacle (cross-sectional area for the passage of the insertion portion of the internal receptacle) and allow the upper flange ring of the internal receptacle to be mounted directly from above on the support flange, without placing the internal receptacle in contact with the external receptacle.

each among the lower and upper flanges is made of a single piece of molded plastic.

the upper flange is made of a more rigid material than that of the lower flange.

According to one feature, a bayonet-type attachment of the flange may be preferred in order to limit rotational movement while locking. The attachment is carried out by engagement between glass reliefs provided in recesses (in the case of a bayonet attachment) and engagement members formed in the flange.

The interface, which forms a retaining ring with two superimposed clamping parts, allows clamping an internal receptacle made of non-deformable rigid material, preferably glass, the external receptacle being made of glass.

Also proposed, in accordance with the invention, is a packaging unit of the type with a closure system. The packaging unit comprises the container according to the invention as well as a lid (repositionable) which allows closing off the opening of the internal receptacle at least after the first use/opening (in order to start consuming the product), the lid having a side wall surrounding a peripheral outer side face of the retaining interface.

Typically, the side wall element of the upper flange defines a peripheral outer side face of the interface, which is preferably provided in order to cooperate with the lid. The side wall element may have an annular lower free edge facing an annular outer shoulder of the external receptacle (this shoulder forming the transition between the side wall of the external receptacle visible in the closed state of the lid and the attachment neck of the lower support flange). The lid may be attached elsewhere than on the refill (internal receptacle), so that there is no risk of affecting the mechanical strength of this refill (in particular when the lid is made of metal, glass, or other similar rigid material).

Optionally, at least among the peripheral outer side face, an inner face of the annular end, and an outer face of the annular end, defines an annular area of contact with the lid, obtained by attaching the lid on the interface, preferably by an action of relative rotation of the lid with respect to the interface.

Optionally, an annular sealing contact is created by such an area of contact which is continuous. According to one feature, an insertion gasket seal is provided, included in or made integral with the lid, this seal being capable of being inserted inside the internal receptacle and forming a radial annular sealing contact against an inner face of the annular upper end.

Furthermore, the invention aims to obtain an assembly of a container of the aforementioned type, compatible with easy steps of disassembly while making the position of the internal receptacle stable and spaced apart from the external receptacle.

To this end, a method of assembly for obtaining the container is proposed, by mounting an internal receptacle formed of a single piece of mineral material in an external receptacle made of non-deformable mineral material such as glass, preferably transparent, the method comprising:

- the coupling of a support flange which is annular around an upper end of the external receptacle, by removable attachment means;
- the insertion of the internal receptacle into an interior volume of the external receptacle through a longitudinal opening of the external receptacle and through a through-opening of the support flange, in a direction parallel to a longitudinal axis of the internal receptacle, until a pre-positioned configuration of the internal receptacle is obtained in which the annular upper end of the internal receptacle is bearing axially on an upper contact face that is part of the support flange,
- the formation of a retaining interface for immobilizing the internal receptacle, by coupling an upper flange to the lower flange by axially clamping between the lower flange and upper flange at least one engaging edge provided at the annular upper end, whereby the internal receptacle is held spaced apart from the external receptacle in an end position configuration, the support flange being fixedly coupled in a position of axially overlapping the upper end from above while enabling:

- a detachable attachment of the upper flange, in an engagement area that is offset radially outwards relative to an axial area of contact between the at least one engaging edge and the upper contact face,
- optionally, the distribution of the areas of contact and attachment on the upper end of the external receptacle (inner side) and the areas of contact with the lid in different and complementary angular sectors.

The upper flange may extend around the internal receptacle and therefore typically consists of a piece having a through-opening which does not reduce the cross-sectional area of the opening of the internal receptacle. Preferably, the upper flange is fully offset outwards relative to the opening of the internal receptacle forming the access through which the product exits the container. In this manner, the product contained in the internal receptacle made of glass or similar inert material can be removed with no risk of contact against the upper flange.

According to one feature, a centering of the internal receptacle within the external receptacle during formation of the retaining interface is carried out by:

- an adjustment of position between an inner face of a side wall element included in the upper flange and an opposing wall of the support flange, said opposing wall being surrounded by the inner face; and
- a guiding by the upper flange of a follower projection formed on said annular upper end, the follower projection preferably projecting axially outwards (typically through the through-opening of the upper flange).

It is understood that the internal receptacle can traverse a respective through-opening of each of the flanges, on the one hand by the side wall which passes through the lower support flange at the moment of insertion into the external receptacle, and on the other hand by the follower projection which (in the assembled state of the interface) is typically an annular projection housed in and/or extending through the through-opening delimited by the upper flange.

For example, two, three, or four tabs (possibly more) may be provided which form the elastically deformable engagement portions in the lower support flange. These tabs are distributed regularly over the circumference of the annular side portion of the support flange, typically alternating with rigid portions (which for example extend further in the circumferential direction than the tabs). Threads or other reliefs for guiding rotation are optionally provided externally on these rigid portions.

BRIEF DESCRIPTION OF THE DRAWINGS

Other features, details, and advantages of the invention will become apparent upon reading the detailed description below, and upon analyzing the appended drawings, in which.

DESCRIPTION OF THE PREFERRED EMBODIMENTS

In the various figures, identical references indicate identical or similar elements.

In the figures, the respective axes X and X' of the internal receptacle 10 and external receptacle 20 are positioned vertically. The receptacles 10, 20 are different and can therefore be designed separately. In the figures, the up/down direction is defined along the direction of the longitudinal axes, so that the widthwise direction of the container is a radial direction and the heightwise direction of the container or of one of its components is a longitudinal direction.

Figure 1:
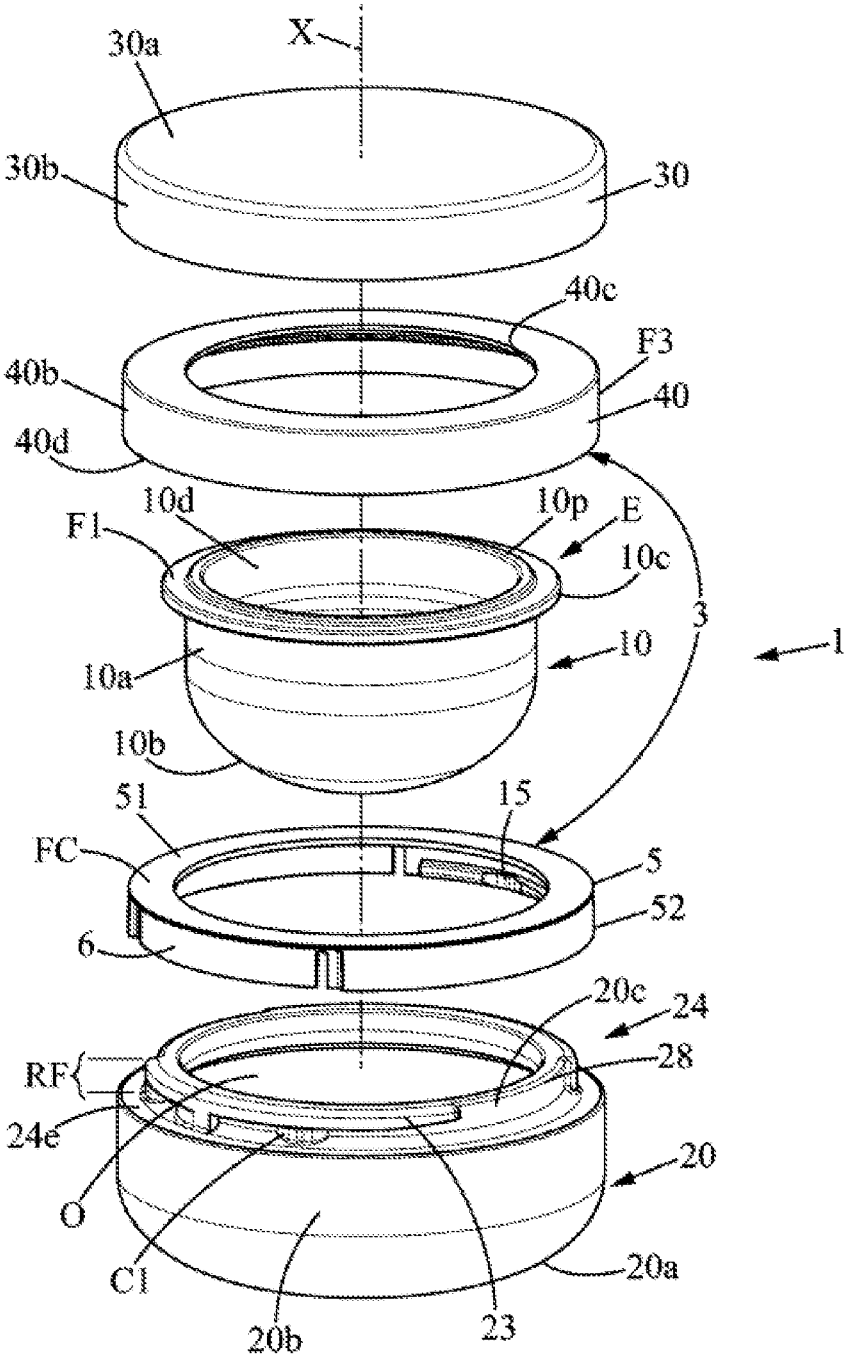
FIG. 1 is an exploded perspective view of a container according to one embodiment of the invention, enabling the installation of an internal receptacle into the interior volume of an external receptacle in a stable and removable manner, a lid above the container also being illustrated.
Figure 2:
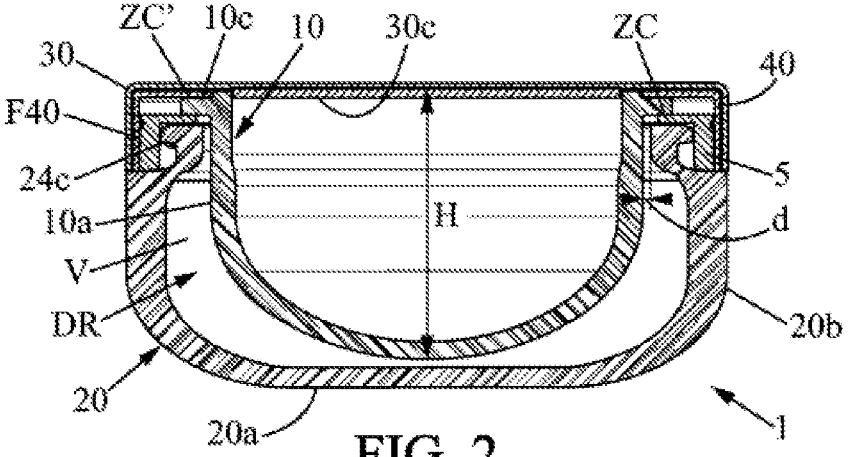
FIG. 2 is a longitudinal/vertical sectional view, illustrating the container of FIG. 1 in an assembled state (omitting, as in FIG. 1, the product and any membrane seal) and closed off here by an attached lid, with a flange ring of the internal receptacle interposed between two flanges of a mounting interface.
Figure 5:
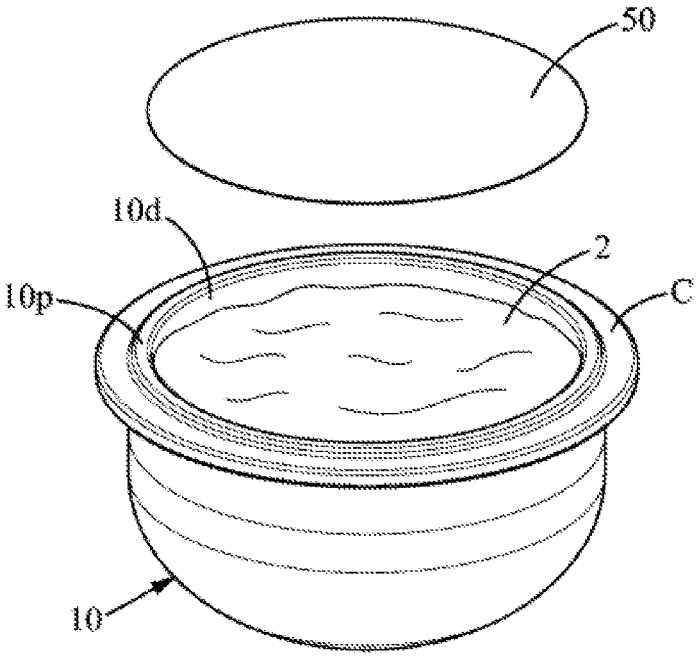
FIG. 5 is a perspective view illustrating the internal receptacle filled with a product, before a step of sealing with a membrane seal.

Referring to FIGS. 1, 2, and 5, provision is made to form a reservoir for product as one piece, which is an internal receptacle 10 made of inert rigid mineral material. The glass typically used to form the external receptacle 20, visible in FIGS. 1 and 2 in particular, is preferably obtained from silica and is typically transparent or translucent. The glass or other rigid mineral material of the internal receptacle 10 and that of the external receptacle 20 may be identical or different, the internal receptacle 10 possibly being opaque in certain options. The material of the internal receptacle 10 is suitable for forming a chemically inert material (without internal coating or lacquering), allowing contact that is compatible with long-term storage of a product 2 poured/deposited in the internal receptacle 10. A polymer providing great impact resistance such as PET or PCTG may also be used to form all or part of the internal receptacle.

Internal Receptacle

The internal receptacle 10, also called a cup, may have a tubular side wall 10*a* which extends around the longitudinal axis X between a bottom wall 10*b*, for example with a flat or rounded bottom (to form a downward-facing dome), and a flange ring C which defines an axial annular upper face F1, surrounding the single opening 10*d* of the internal receptacle 10. The (horizontal) cross-section of the side wall 10*a* may be circular or oval. The receiving volume (corresponding to a single cavity here) of the internal receptacle 10 may be suitable for storing the product—cosmetic, pharmaceutical, or other product, which is typically fluid, semi-fluid, or pasty—inside the external receptacle 20. In some options, the flange ring C may be non-circular or discontinuous, or optionally replaced by at least two separate engaging edges and which each project radially outwards in different and/or substantially opposite directions. In some options, the flange ring C is a ring forming a shoulder, possibly axially spaced from the body of the internal receptacle and/or spaced from the uppermost face of the internal receptacle. The flange ring C may be injected/secured directly on a tubular upper part of the internal receptable or included in the same piece of rigid mineral material.

Although the drawings show a single compartment for receiving the product 2, provision may be made to form a longitudinal partition wall connecting two distinct regions of the inner face of the side wall 10, in order to form at least two separate compartments within the internal receptacle 10.

Referring to FIG. 2, the width or outer diameter of the internal receptacle 10 at mid-height may be at least equal to 90% or 100% of the inner diameter of the opening 10*d* of this receptacle 10, in order to optimize the capacity of the internal receptacle and thus minimize the area of space between the receptacles, which corresponds to an annular volume not intended to receive any content in most applications envisaged. In addition, the height H of the internal receptacle 10 may represent more than 85 or 90% of the total height of the external receptacle 20.

An annular projection 10*p* projecting axially upwards, for example in the axial extension of the inner face delimiting the volume for receiving the product 2, is optionally formed on the upper face F1. The face F1 can then be subdivided into a protruding portion corresponding to the annular projection 10*p* and a peripheral portion, here included in the flange ring C, and defining a flat annular upper surface.

As can be seen in FIGS. 1 and 2, this flat annular upper surface defines a seat for supporting a part forming an upper flange 40, meaning for forming an axial area of contact ZC, for example annular, between the flange ring C and a lower face of the upper flange 40 which will be described in detail further below. Opposite this flat annular upper surface, the flange ring C defines a flat annular lower surface also provided for forming an axial area of contact ZC', for example annular, but this time between the flange ring C and the upper face FC of a lower flange 5 (flange upholding/supporting receptacle 10). The lower flange 5 will be described in more detail below. In other words, the flange ring C can form a portion clamped between two annular flanges 5, 40. More generally, this type of clamping is obtained with at least one engaging edge 10*c* such as a flange ring C, which is an integral part of the internal receptacle 10 (i.e. included in the single piece forming the internal receptacle or rigidly secured to the upper annular end of the internal receptacle).

It is understood that the annular projection 10*p* may form a barrier preventing the product 2 from laterally reaching a flange in the overlapping/sandwiched area of the flange ring C. Thus, the risk of the product 2 being in direct contact with the material of the upper flange 40, which typically may be of plastic, is reduced.

The flange ring C is an upper flange ring, which surrounds the opening 10*d*. The flange ring C has a lower face intended to rest axially on the lower flange 5 which is interposed axially between an upper free face of the external receptacle 20 and the lower face of the flange ring C. In this example receptacle 10 is composed of the body (10*a*, 10*b*) forming part of the reservoir, and the flange ring C. The flange ring C is not necessarily included in same piece as the body part. The height of the flange ring C is reduced, for example not exceeding 7 or 12 mm, and preferably is less than or equal to 4 mm. The amount of material in the flanges 5 and 40 can be reduced by limiting the dimensions of the flange ring C. The radial extension of the flange ring C may be greater than or equal to the height of side portion 52, without exceeding 7 or 12 mm for example. The use of a flange ring C facilitates manipulations for high-speed assembly, by forming a grip and by reducing stresses from friction (radial friction) against the retaining interface 3.

Although the examples illustrated show a flange ring C projecting outwards relative to the rest of the internal receptacle 10 in order to form an annular engagement relief, the same type of annular relief may also be formed, forming an engaging edge 10*c*, by creating two parallel grooves between which such a relief, of the annular bead type, extends. In this case the flanges 5 and 40 can have a certain flexibility in order to enter a corresponding groove. At least one groove formed in the upper end E or other types of anchoring reliefs can make it possible to obtain an effect of axial bearing of the internal receptacle 10 on the lower flange 5 and upper flange 40 respectively. An anchoring of this type is generally more effective by providing a continuous annular area of contact or a peripheral region in which the discontinuities are of reduced size compared to the engagement sub-areas.

External Receptacle

Figure 6:
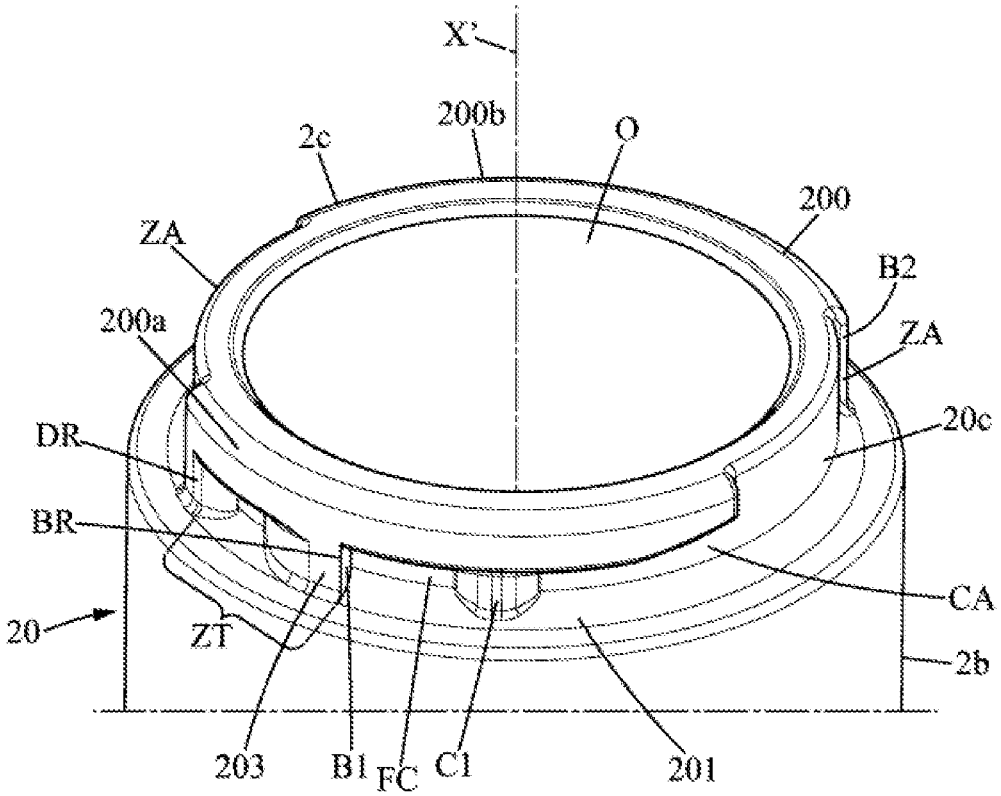
FIG. 6 is a perspective view showing details of the top of a bottle or pot forming the external receptacle, in an embodiment of the invention identical or similar to that of FIGS. 1 and 2.

In the examples illustrated in FIGS. 1, 2, and 6, the external receptacle 20 has an interior volume V accessible via a longitudinal opening O defined by a neck 24*c*. This type of neck C (or receiving member 24*c*) forms all or part of the upper end 24 of the external receptacle 20 and makes it possible to mount the lower flange 5 in order to obtain a coupling state in which the lower flange 5 is axially fixed relative to the external receptacle 20.

The external receptacle 20 has a bottom 20*a*, and a side wall 20*b* which extends longitudinally around an axis up to the annular neck 24*c*. The longitudinal opening O may be relatively wide to enable the passage of an insertion portion of the internal receptacle 10. Such an insertion portion typically corresponds to the portion of the internal receptacle 10 located under the engaging edge 10*c*.

Referring to FIGS. 1, 2, and 6, an outer shoulder 24*e* of receptacle 20 may separate/make the transition between the side wall 20*b* and the annular neck 24*c*. In this example, the neck 24*c* does not serve for attachment of a lid 30, the lid not being directly connected to the lower portion 20, 5 of the container 1 (portion extending below the internal receptacle 10). Although FIG. 2 shows a neck 24*c* reducing the cross-sectional area of the internal cavity forming the volume V, in other options it is possible to provide a neck which simply extends the inner face of the side wall 20*b* axially.

Here, the upper end 24 is provided with removable attachment means for rendering the support flange 5 integral with the upper end 24 by allowing the coupling state of the lower flange 5 to be locked by a rotational action, for example by screwing or by a bayonet-type connection.

As is clearly visible in FIG. 1, the annular neck 24*c* has for example recesses 20*c* which are at least two in number, to form guides for a bayonet attachment. Each recess 20*c* may be axially open at the top, as is clearly visible in FIGS. 1 and 6. Two longitudinal edges or sides B1, B2 further define this recess 20*c* laterally. Approximately half of the upper opening 28 of the recess 20*c* is blocked by a projecting rib 23. This rib 23 extends, in a circumferential direction, between a longitudinal edge B1 and a recess middle area which is distant from the longitudinal edges B1 and B2.

Although the drawings show an interior volume V of the external receptacle 20 in which the depth corresponds substantially to the total height of the internal receptacle 10, other housing arrangements for fully or partially receiving the internal receptacle 10 in the interior volume V may be considered. More generally, the height H of the internal receptacle 10 may vary, even if it may be preferred—for reasons of size and of optimizing the refilling with product 2 with respect to the overall size of the container 1—to limit the difference in height between the receptacles 10 and 20 to less than 20 or 25 mm. It is also possible to place the top of the internal receptacle 10 at least 2 or 6 mm higher than the level of the longitudinal opening O of the external receptacle 20, preferably without protruding by more than 8 or 10 mm for example. Referring now to FIGS. 1 and 6, one can see an exemplary embodiment of a jar forming the external receptacle 20, in which receiving means (23, 201) are provided for receiving a bayonet-type connection. Connection means, complementary to the receiving means, are provided in the lower flange 5.

Lower Flange and its Assembly on the External Receptacle 20

The connection means provided in the lower flange 5 for mounting it on the external receptacle 20 are typically formed on the side of an inner side face F5, for example by forming lugs 15. These are optionally elongated. This makes it possible to configure a reusable portion of the container 1, consisting of the external receptacle 20 and the connector/interface portion formed by the lower flange 5. Here the lower flange 5 remains unexposed in the assembled state of the container 1.

The lower flange 5 may be a part entirely outside the interior volume V of the external receptacle 20, and essentially consists of:

a flat portion 51 axially overlapping the neck 24*c*; and an annular side portion 52 for attachment on this neck 24*c*.

The axial overlap may be partial or complete, depending on the geometries of portion 51.

The flange 5 has an annular shape around a central axis which typically may be coincident with the respective longitudinal axes X, X' of the receptacles 10, 20, in the assembled state of the container 1. In a longitudinal section view as can be seen in the non-limiting example of FIG. 2, the flange 5 has an inverted "L" profile. It thus has an annular radial portion constituting the flat portion 51 which can form a portion interposed between an upper face of receptacle 20 and the engaging edge 10*c*. It can thus be inserted via this portion 51 between two glass walls of the receptacles 10 and 20.

In the example of FIG. 1, the flange 5 is represented with a smooth outer side face. However, it is possible to provide areas with ribs or any means facilitating gripping, in particular to facilitate mounting the support flange 5 on the neck 24*c* of the external receptacle 20. The flat upper portion 51 of the lower support flange 5 may have one or more projecting edges which also facilitate gripping.

Figure 3:
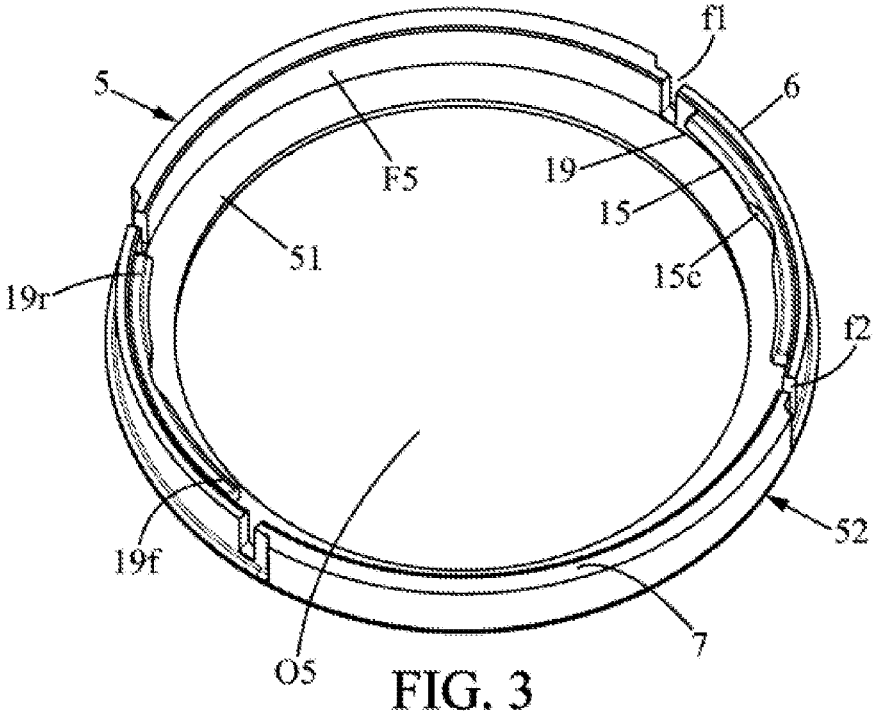
FIG. 3 is a perspective view from below, showing an annular support flange for supporting the internal receptacle, used as an internal part (typically not exposed) in the assembly of parts that constitute the container of FIGS. 1 and 2.

As can be seen in FIGS. 1 and 3, the flange 5 may be a part made of plastic whose thickness is chosen to prevent radial movement in at least two arcuate portions 7 of the annular side portion 52 which have a circumferential extension corresponding to an angular sector of at least 60 or 90°.

Figure 4:
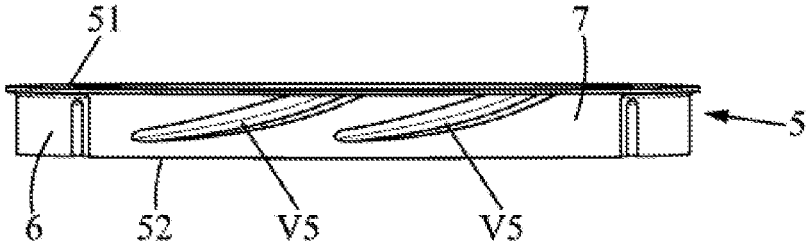
FIG. 4 is a front view of a part similar to that of FIG. 3, in a variant enabling rotational attachment of an upper flange on the lower support flange formed by this part.

In the embodiment of FIG. 4, the external locking members V5 are formed in one or more regions of the annular side portion 52 which are separate from the elastically deformable portion or portions 6. Here for example, only the thicker portions 7 carry the threads or similar external locking members V5. More generally, any distribution between deformable portions 6 (with radial movement allowed) and portions receiving a covering element may be provided, at least when the external receptacle 20 is suitable for a bayonet-type connection.

In some variants, the flange 5 may be a plastic part of which the thickness may vary and/or which may have reinforcing ribs to prevent radial movement in at least such arcuate portions of the annular side portion 52.

In preferred options, elastically deformable portions 6 are provided which are defined between two slots f1, f2 and which support internal lugs 15. The material is chosen to be less flexible than an elastomer, which makes it possible to form relatively rigid arcuate portions 7 and thus not very deformable by radial movement.

FIGS. 1 and 3 illustrate the non-limiting case of several elastically deformable portions 6, for example at least two in number, integrated into portion 52. In certain variants, it is possible to limit this to a single elastically deformable locking member.

It is permitted to form a pair of tabs or similar locking means which constitute these deformable portions 6. These portions each have two longitudinal sides, one delimited by longitudinal slot f1, the other by longitudinal slot f2 which here is parallel to slot f1. It is optionally possible to form a hinge area 19 at the base of the locking tab, to allow movement about this hinge area 19. The thickness of the deformable portions 6 may be less than the thickness of portions 7 to allow this movement.

In some options, this type of slots f1, f2 may correspond to a pair of recesses or slot segments which extend each other and/or join together, these areas being located for example within a same notch. The lower edge of the deformable portions 6 may be at the same level as the lower edge of complementary portions 7.

The internal receptacle 10 and the external receptacle 20 here have a circular cross-section, in any cross-sectional plane perpendicular to the axes X and X', these axes typically being coincident. This geometry facilitates the integral connection between the receptacles 10, 20 by means of the flanges 5, 40, by:

- a combination of a longitudinal insertion movement to obtain the support of portion 52 of the lower flange 5 on the shoulder 24*e*, and a relative rotation of the flange 5 with respect to the external receptacle 20 (case of a bayonet-type attachment); and
- a combination of a longitudinal insertion movement of the internal receptacle 10 to obtain the support of the edge 10*c* on the lower flange 5, and a simple attachment movement of the upper flange 40, which may be clipping (elastic interlocking), insertion by force, or relative rotation or screwing of the upper flange 40 on the lower flange 5, preferably obtaining an integral attachment that is removable (allowing disassembly) of the upper flange 40, while axially obstructing the edge 10*c*. The little or no radial play between a peripheral area of contact of the wall 20*b* and the inner edge of portion 51 of the flange 5 make it possible to ensure the centering of the internal receptacle 10, typically so that its longitudinal axis X is coincident with the longitudinal axis X' of the external receptacle 20.

In some variants, the portion 51 may have radial tabs or lip(s), preferably flexible, in contact with the side wall 10*a*.

The external receptacle 20 has for example a lip 200 or similar rim portion formed in the neck 24*c* which includes the upper annular edge 2*c* of the body constituting the external receptacle 20. The neck 24*c* may advantageously have little axial extension, for example less than 16 or 20 mm. A relatively small axial extension makes it possible to reduce the area of lateral overlap between the external receptacle 20, typically made of glass, and the upper flange 40, and thus to minimize the plastic material required in the designs of the flange 5, in particular by reducing the length of the skirt or annular side portion 52 (see FIGS. 1 and 2) of the flange 5 and by reducing, where appropriate, the extension of the part forming a ring or upper flange 40 (see FIG. 2).

The receiving means 23, 201 extend over this neck 24*c*, in particular with retaining reliefs provided on a side surface portion of the neck 24*c*, in a position adjacent to the shoulder 24*e* of receptacle 20. The shoulder 24*e* extends transversely from the neck 24*c* to reach the top of the side part 20*b*.

Referring to FIG. 6, the lip 200 is discontinuous with notches forming axial passages or access areas ZA, distributed on the circumference, to allow the internal lugs 15 of the lower flange 5 to descend substantially to the level of the shoulder 24*e* (unlocked low axial position of the internal lugs 15). From such a low axial position of the lower flange 5, all that remains is to turn the flange 5 (here in the clockwise direction, but this is non-limiting) relative to receptacle 20 or conversely body 20 in the reverse direction of rotation, relative to the flange 5.

The rotation is preferably of the type representing substantially a quarter turn (plus or minus 10°). The lip portions, separated by the access areas ZA, may be two in number, representing an angular sector between 80 and 105°, for example around 95° (the access area ZA then possibly representing an angular sector between 75 and 100°, for example around 85° in the non-limiting example of FIGS. 4 to 6).

Receptacle 20, here made of glass, may be designed with reliefs and a delimitation of lateral cavities 201, in order to obtain pre-tightening then end-of-travel locking, during the pivoting of the annular side portion 52.

To keep the lower flange 5 integrally secured to the body 2, an inner assembly face F5 is provided on the inner side of the skirt constituting the annular side portion 52. The inner assembly face F5 is connected to the annular edge 2*c* of the body 2 by engagement of the internal lugs 15 under the radial projections or under the lip 200 of this annular edge 2*c*.

In the embodiments of FIGS. 1 and 6, one can see that the neck 24*c* includes at least one lateral cavity 201 for receiving a corresponding internal lug 15 which is part of the connection means belonging to the flange 5. The cavity 201 visible in FIG. 6 is delimited axially between a portion 200*a*, 200*b* of the lip 200 and the shoulder 24*e*, and extends circumferentially between a terminal area ZT and an access channel CA which narrows in cross-section as it approaches the retaining reliefs. The terminal area ZT may be elongated and/or may include an abutment surface having a radially outer edge BR, such an abutment surface being formed in a protruding projection 203. This structure may be provided for two lateral cavities 201 of the neck 24*c*.

One or more projections 203 are provided in each terminal area ZT, such that each lateral cavity 201 can function as a guide into which tangential sliding becomes harder and harder until it stops with engagement of what is referred to as a front end 19*f* (attacking or proximal end) of an internal lug 15 against a last abutment relief. In the example illustrated, two diametrically opposed internal lugs 15 thus cooperate with diametrically opposed retaining surfaces of the receptacle 20, for a position where the neck 24*c* is covered by portion 52.

It is possible to use protruding reliefs in the terminal area ZT, in order to push at least the front end 19*f* of the internal lugs 15 radially outwards. At the end of travel or just before and at the moment the locked configuration is obtained, the (relatively flexible) deformable portion or portions 6 of portion 52 move away radially outwards because each of the internal lugs 15 then covers a terminal area where the projection 203 extends. In the illustrated example, each deformable portion 6 returns slightly inwards radially, at the end of travel, because each projection 203 enters an intermediate recess 15*c* present in the internal lug 15. Further behind this intermediate recess 15*c* (in the distal position) of the internal lug 15, there is a rear or distal end 19*r* which may extend, in the locked configuration, between the projection 203 (by abutting against the corresponding abutment surface B1) and a protruding catch C1. The projection 203 and the catch C1 obstruct an accidental disengagement of the internal lug 15 but can be overcome with sufficient rotational actuation force, due to the elasticity of the deformable portion 6. It is recalled here that the neck 24*c* is made of a mineral material, preferably glass (non-deformable material, which breaks before deforming).

In FIG. 6, one can thus see for the lateral cavity 201, between the access channel CA of narrowing cross-section (here narrowing axially) and an end-of-travel region optionally delimited by a last relief DR, the presence of a catch C1 then of a projection 203 delimiting an abutment surface oriented towards the catch C1. The same configuration is typically used in the other lateral cavity (with another catch C1 preceding a similar projection 203).

Each catch C1 here has a height, measured from the bottom surface FC, which is less than a depth of the lateral cavity, measured between the radially outer edge BR of the abutment surface B1 and the bottom surface FC. In addition, the catch C1 corresponds to a gradual swell or bulge formed on the bottom surface FC, while the abutment surface B1 may be at an angle of around 90° relative to the bottom surface FC, as shown in FIG. 6.

More generally, the locked configuration can be obtained when each internal lug 15, here having an elongated shape in a circumferential direction, is placed in a corresponding lateral cavity 201, while extending on either side of an abutment surface B1 of the lateral cavity 201, preferably by being inserted into the lateral cavity 201 beyond a catch C1 of said lateral cavity.

The lower flange 5 can thus be integrally secured to the body 2 in the locked state of the bayonet-type connection. The lower flange 5 thus remains integrally secured to the receptacle 20 during use of the container 1. This makes it possible to use this flange 5 as a support both for a flange ring C or any suitable upper engaging edge of the internal receptacle 10 and as a support for a part (ring) forming the upper flange 40.

Specific Features of the Maintenance Interface 3 as Illustrated

The lower flange 5 and upper flange 40 cooperate to form a retaining interface 3, above the external receptacle 20, completely outside the interior volume V. The retaining interface 3 allows mounting the internal receptacle 10 while minimizing the overall height, but without interfering with the area for taking up product 2. In preferred embodiments, the lower flange 5 and upper flange 40 may each have a side portion which extends plumb with the shoulder 24*e* of the external receptacle 20, without protruding outwards relative to the outer face of side wall 20*b*. The annular lower edge 40*d* of the skirt or side wall 40*b* of the upper flange 40 can thus optionally be facing the shoulder 24*e*.

When the internal receptacle 10 is made of glass, each of the flanges 5, 40 may be made of a plastic material suitable for contact with glass. However, the upper flange 40 may also consist of a metal ring optionally covered with a coating, a lacquer, or any suitable covering (of low thickness, for example not more than 25 or 50 micrometers, preferably by forming a film less than 15 micrometers thick), in an annular area of contact against the glass of the internal receptacle 10. The same arrangement is applicable for an internal receptacle 10 made of another rigid inorganic material.

Referring to FIG. 2, the upper flange 40 forms the upper outer face of the interface 3 which may be flush with the level of the upper surface of the annular projection 10*p*. More generally, it is understood that the interface 3 may add no height to the size of the internal receptacle 10.

Furthermore, as is clearly visible in FIG. 2, the upper flange 40 has a through-opening wider than that of the internal receptacle but typically of reduced cross-section (less than or equal) compared to the through-opening O5 of the internal receptacle 10. Here, the through-opening of the upper flange 40 can thus define an inner diameter greater than the inner diameter of the opening 10*d* of the internal receptacle 10 and smaller than the inner diameter of the through-opening O5 of the support flange 5.

Although the illustrated examples show a lid 30 attached to the upper flange 40, options for attachment to the lower flange 5 or to the external receptacle 20 are also possible in some variants. However, the overall height can be minimized and exposure of the technical part constituting the support flange 5 can be avoided by mounting the lid 30 directly on the upper flange 40.

With reference to FIGS. 1 and 2, one can see that the container 1 may comprise for example four parts:

- the internal receptacle 10 intended to receive the product 2,
- the external receptacle 20 provided to house the internal receptacle, and
- the lower and upper flanges 5, 40 which form the retaining interface 3 for mounting (assembling) the internal receptacle 10 in the external receptacle 20 with a distance maintained between them.

Figure 8:
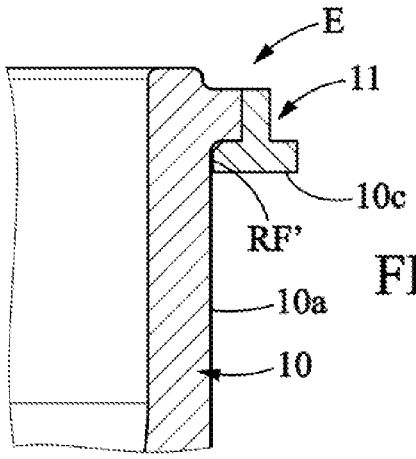
FIG. 8 is a cut view showing an exemplary flange ring according to another embodiment, the flange ring being secured at annular upper end of the internal receptacle and forming an engaging edge suitable to be sandwiched by a retaining interface.

The internal receptacle 10 includes the flange ring C or similar part suitable to be sandwiched between flanges 5, 40. In some options, the internal receptacle is a preassembled unit with the flange ring C being initially made separately (separate piece 11) and secured around the annular upper end E, as illustrated for instance in FIG. 8. A screwing, a clipping, injection on a peripheral fastening region RF (or similar operation) may be used for performing rigid connection of the flange ring C and thus obtaining the preassembled unit. Whatever options are chosen, the part forming the reservoir for product is provided with at least one engaging edge 10*c* so that the internal receptacle 10 can be maintained by the retaining interface 3 (here a two-piece interface with the flanges 2, 40) at a given suspended position inside the external receptacle 20.

With glass receptacles 10, 20, maintaining this distance eliminates any risk of breakage or unwanted noise. The lower flange 5 constitutes the only intermediate (interposed) part between the external receptacle 20 and the internal receptacle 10, which is advantageous for the assembly of the reservoir-containing lower portion of the complete packaging device. The lid 30 and the upper flange 40 may optionally be attached to each other before closing off the opening 10*d* of the internal receptacle by attaching face F40 of the upper flange 40 against the lower flange 5. In this case, immobilization of the internal receptacle 10 is achieved at the same time as placement of the lid 30. An optional membrane seal 50, visible in FIG. 5, may already be sealingly fixed onto the upper surface defined by the annular projection 10*p*. The lid 30 may also have an insertion gasket seal 30*c* which is inserted inside the internal receptacle 10 and creates a radial annular sealing contact against an inner face of the annular upper end E. Such an insertion seal 30*c* is rendered integral with the lid 30 by being able to constitute an element added and welded, glued, or mechanically connected to the lower face of the lid 30.

Alternatively, the retaining interface 3 may first be assembled in order to sandwich the engaging edge 10*c*, here in the form of a flange ring C. Then the lid 30 can be attached. It is also possible to provide a hinge-type lid in certain options, connected to a hinge portion that is integral to the external receptacle 20.

The lid 30 may be implemented in different ways. In the drawings, the lid 30 has a flat bottom wall 30*a* and a side wall 30*b*. The outer face of the packaging unit composed of the container 1 and the lid 30 may then be composed of the side wall 30*b* of the lid 30 and the side wall 20*b* of the external receptacle 20. In some variants, one of the flanges 5 and 40 also contributes to forming a portion of the visible outer face of the packaging unit. Thus, the lid 30 may be of the type with an internal skirt for attachment to the upper flange 40, with no side wall covering the wall 40*b* of the upper flange or at least without completely covering this wall 4*b*. In this case, side wall 40*b* is visible from the outside, interposed between side wall 20*b* and an edge of the lid 30.

For the external decorative covering of the container 1, after removal of the lid 30, it may be arranged that only the upper flange 40 is visible from the outside. In other words, portion 52 of the lower flange 5 is entirely covered by the part forming the upper flange 40 which is preferably rotationally integral with the lower flange 5. It is optionally permitted to axially extend the external side face of receptacle 20, with a perimeter of the upper flange 40 whose format and length are very close or identical (with surface continuity). In addition, the material of the upper flange 40 may be chosen to have a more customizable aesthetic appearance than the lower flange 5 which can have slots f1, f2 and technical reliefs. It is understood that the production cost of the lower flange 5 can be reduced since it can be identical, therefore produced in large quantities, regardless of the external appearance of the external receptacle 2 and/or the upper flange 40 which typically may vary.

As is clearly visible in FIGS. 1 and 2, it is understood that the volume for receiving product is accessible from above through the upper flange 40, via the through-opening in this flange 40, which here is relatively wide.

More generally, provision is made for any type of retaining interface 3 enabling the internal receptacle 10 to be removably fixed in the external receptacle 20. Provision may be made for the upper flange 40 to detach first (more easily) from the lower flange 5, for example by simple unclipping or similar disengagement by simply pulling on the upper flange 40. If necessary, a gripping tab or other actuating part may be provided on the outside of the upper flange 40 to facilitate this selective disassembly. The detachment may also be achieved by unscrewing, for example when threads or similar external locking members V5 (here rotational locking) are provided on the side portion 52 of the lower flange 5, as can be seen in FIG. 4.

It is understood that this selective disassembly of the part forming the upper flange 40 is sufficient to release the internal receptacle 10. This makes it possible in a simple manner to carry out a refill operation replacing only the internal receptacle 10. Advantageously, the portion to be replaced is minimized without the use of complex parts.

Description of a Non-Limiting Example of Assembly

Successive steps of a method for assembling the container 1 will now be described, in particular with reference to FIGS. 1 to 3 and 6-7.

The external receptacle 20 and the lower support flange 5 are first assembled, here without the neck 24*c* passing through the through-opening O5 defined by the flange 5 but by engaging this neck under the radial portion 51. This is achieved by placing the lugs 15 of the side portion 52 in the recesses 20*c* and by exerting a rotation which is quickly blocked after approximately a quarter turn, following a bayonet-type attachment. Of course, another type of coupling of the lower flange 5 (screwing or other) may be used to lock this part, which is typically made of plastic, in the axial position. This coupling is compatible with the generally non-deformable nature of the external receptacle 20.

As can be seen in FIGS. 1 and 2, it is understood that the attachment region RF, here formed on a neck 24*c*, can form an annular coupling area with immobilizing effect, here due to reliefs or catches C1 and ribs 23 projecting outwards. This type of attachment region RF may also be provided elsewhere than on a neck 24*c*, for example on any annular region of the upper end 24 of the external receptacle 20.

After having attached the support flange 5, this flange may project radially inwards (by its inner edge or via intermittent projections) relative to an annular inner edge of the upper end 24. This allows reducing the cross-sectional area defined at the longitudinal opening O of the external receptacle 20, in order to avoid any contact of the internal receptacle 10 to be inserted via passage O5 against the material of the part forming the external receptacle 20. Alternatively, a centering effect to avoid this type of contact is applied later on, by placing the upper flange 40.

After having protected the top of the external receptacle 20 by the lower support flange 5, the internal receptacle 10 (glass cup in the example shown) can be placed in the external receptacle 20 so that the volume for receiving product 2 lies entirely or primarily within the interior volume V (see positioning in FIG. 2 for example). Insertion may be carried out by sliding, for example without requiring rotation. In some embodiments, this sliding is carried out in a direction parallel to the longitudinal axis X of the internal receptacle 10 which then typically is coincident with the longitudinal axis X'. A pre-positioned configuration of the internal receptacle 10 is obtained, the latter still being upwardly slidable (which makes it removable).

To obtain this configuration, the insertion portion located under the flange ring C is inserted through the opening O5 and may still be visible due to the transparent nature of the external receptacle. During this insertion, the product 2 may already be stored in a sealed manner under a membrane seal 50 previously welded to the upper annular end E, here on the annular projection 10*p* or some other suitable annular area provided for sealing.

In the inserted state of the internal receptacle 10, the upper flange ring C of the internal receptacle 10 bears directly on the support flange 5 from above. When an annular projection 10 is provided, there then may typically exist a series of two successive annular shoulders, in "staircase" form, to make the transition between the top of the projection 10*p* and the annular side portion 52. The assembly of the upper flange 40 makes it possible to cover these two shoulders simultaneously, as is clearly visible in FIG. 2. The axial contact of the upper flange 40 may be made on the top of the flange ring C, around the annular projection 10*p*, preferably with no axial contact on the lower flange 5.

Figure 7:
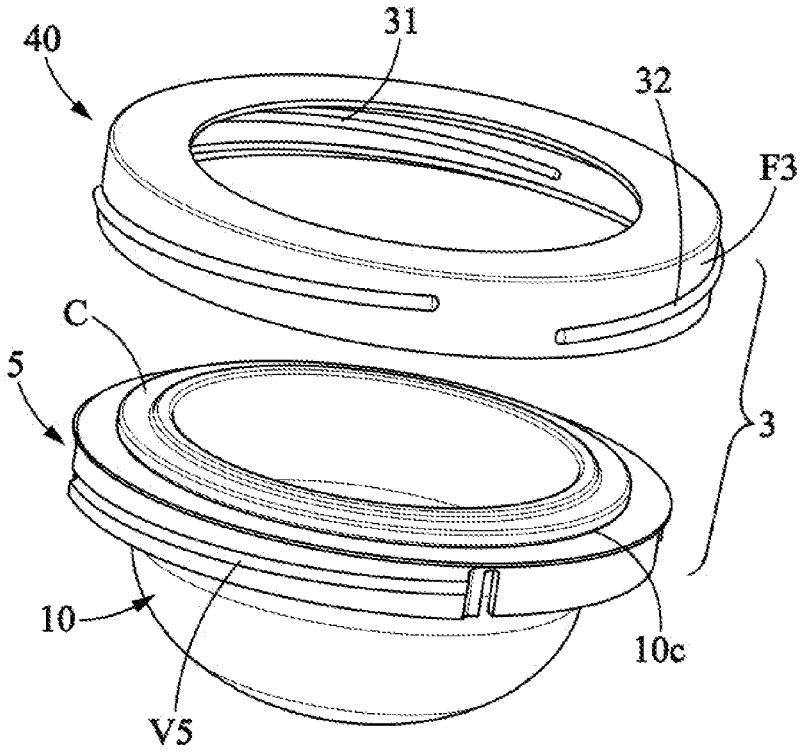
FIG. 7 is an exploded view illustrating an exemplary internal receptacle and associated retaining interface suitable for sandwiching a flange ring provided on the internal receptacle.

The lower flange 5 may be surrounded when the upper flange 40 is put in place, forming the retaining interface 3. The internal receptacle 10 may then be directly immobilized when the upper flange 40 abuts axially against and tightens the flange ring C (or other edge portion), while being engaged with the annular side portion 52 of the lower flange 5. By coupling the upper flange 40 on the lower flange 5, here the assembly of the container 1 is completed. Referring to FIG. 7, the upper flange 40 may comprise thread elements 32 distributed on the outer side face F3 for fixing the lid 30. Optionally, a screwing using inner reliefs or thread(s) 31 of the upper flange 40 may facilitate assembling of the retaining interface 3, with the inner reliefs 31 cooperating with complementary thread members/locking members V5 of the lower flange 5.

It is understood that the internal receptacle may be in a final position configuration after the axial tightening. The lower support flange 5 and the upper flange 40 are engaged with each other in an engagement area that is offset radially outwards relative to the axial area of contact ZC. It is understood that it is easy to detach the upper flange 40 selectively, while it is not permitted to raise the flange ring C or engaging edge 10*c* relative to the upper face FC of the lower flange 5 as long as the upper flange is in place.

In one exemplary embodiment, a centering of the internal receptacle 10 within the external receptacle 20 is carried out during formation of the retaining interface 3. This centering may be enabled by:

- a positional adjustment between an inner face F40 of a side wall element 40*b* included in the upper flange 40 and an opposing wall (here portion 52) of the support flange 5 surrounded by the inner face F40; and
- a guiding by the upper flange 40 of the projection 10*p* (follower projection) formed on the annular upper end E, during the end of the axial travel of the upper flange 40 in order to reach its low position.

The upper flange 40 may delimit a centering edge 40*c*, the support flange 5 being kept integral with the external receptacle 2 by an attachment selected among a screw or a bayonet-type attachment, whereby the internal receptacle 10 forms an extractable replacement without radial friction against the retaining interface 3. Preferably, this replacement does not require any clipping, the internal receptacle 10 not abutting axially under any relief of the support flange 5.

In other words, the upper flange 40 locks the axial position (immobile within the container 1) of the internal receptacle 10, as is clearly visible in FIG. 2, so as to immobilize the internal receptacle 10 in a predetermined position relative to the external receptacle 20. This locking is typically carried out independently of the presence or absence of the lid 30 which is a distinct and detachable element of the container 1. The removal of the lid 30 here has no consequence on the integrity of the interface 3 and on the locking function of the support flange.

As is clearly visible in FIG. 1, the upper flange 40 may consist of one part, here annular, delimited between an annular outer edge which may constitute a lower edge 40*d*, placed at the bottom of the side wall element 40*b* of the flange 40, and an inner edge which may optionally provide a centering function (edge 40*c*). It is understood that the through-opening for accessing the interior of the internal receptacle 10 may be delimited by this inner edge.

The outer face of the upper flange 40 serves here as a decorative covering, in particular in addition to the outer face of the side wall 20*b*. Indeed, the container 1 has an outer decorative covering implemented at least by two parts stepped in the heightwise direction. It will be understood that the lid 30 does not contribute here to the exterior covering of the container 1 but defines its own exterior covering which may partially hide/cover the top of the exterior covering of the container 1. Although the drawings show the case of a lid 30 separate from the container 1 which covers the side wall element 40*b* laterally and from above (by axially covering the entire top of the interface 3), it is understood that the closure part serving to close off the central opening of the retaining interface 3 may be implemented differently.

As illustrated in FIG. 2 in particular, the spacing d between the inner side face of the neck 24*c* and the side wall 10*a* may be at least equal to 1 mm, and preferably between 1 and 2 mm, in an assembled configuration (configuration locked in position with the upper flange 40 in the final coupling position). Said centering effect may make it possible to minimize this spacing d while allowing higher manufacturing tolerances for the component glass part or parts of the container 1 than for molded plastic parts.

There may be a radial spacing substantially equal to or even greater than this spacing d, between the side wall 10*a* and the inner edge of the radial flat portion 51 of the flange 5, so as to provide a sufficiently large radial clearance to make it easy to extract the internal receptacle during an operation of replacing the internal receptacle 10.

The flange 5 may be thicker or have a maximum thickness in its annular portion 52, while the flat portion 51 may be thinner on average (for example with a thickness at least two times thinner than the minimum thickness of portions 7). The periphery of the side portion 52 may allow a simple and robust attachment of the upper flange 40 with a locking configuration, without interfering with the coupling state of the lower flange 5 on the neck 24.

The presence of a lid 30 makes it possible to form a packaging unit which encloses the product in a sealed manner after the first use (after removal of the membrane seal 50). The side wall 30*b* may surround the peripheral outer side face F3 of the interface 3, so that the interface is not exposed. The peripheral outer side face F3 may be composed of the upper flange 40. Here, the side wall 40*b* has an annular lower free edge 40*d* facing the external annular shoulder 24*e* of the external receptacle 20, which may optionally come into contact against this shoulder 24*e* to obtain a stop effect marking the end of travel in placement of the lid 30. The lid 30 may be placed in position by any suitable method, in particular screwing, clipping. Ribs or threads in the lower portion of the side wall 30*b* can thus enable quickly putting the lid 30 in place.

Alternatively, the lower flange 5 may be deformable so as to be able to insert portion 52 into a groove delimited by the neck 24*c*, without rotation. In this case, it is understood that the rotational locking of the lower flange 5 can be achieved in a different manner, for example by using rotation blocking member(s) (which may involve rotational indexing during placement of the flange 5). Alternatively, it is possible to dispense with rotational guidance for raising the flange 5 towards the upper end 24.

In the examples illustrated, the cross-section is generally circular for the flange 5 and the internal receptacle 10, at least within the area of contact with the flange 5. However, the receptacles 10 and 20 may have other geometries, in particular at a distance from their respective circular opening.

The flange 5 may also have an adaptational geometry in order to present an inner circumference having rotation-preventing angles or protuberances. In particular, the elastically deformable portions 6 may delimit straight segments, not having an arcuate profile in certain options.

The plane defined by the top of the flat portion 51 of the flange 5 may be at the same level or higher than the level of the annular end E. In other words, the flange 5 may not form a simple support axially sandwiched between a flange ring C of the internal receptacle 10 and the upper face of the external receptacle 20. In some variants where the flange 5 has an inverted "U" profile (including an additional insertion portion connected to the inner edge of portion 51), conversely it is provided that the flange has a for insertion into the internal volume V, for example to make it possible to fully accommodate and therefore embed the internal receptacle 10 harmoniously within the interior volume V of the external receptacle 20 with no axial protrusion at the top, possibly with no protrusion at the top of the annular end E relative to the flat portion 51 of the lower flange 5. It is thus possible, if necessary, to limit the overall height of the container 1.

It should be apparent to those skilled in the art that the invention allows embodiments in many other specific forms without departing from the scope of the invention as claimed. Thus, the material of each flange 5, 40 can be adapted as needed, preferably by choosing a material that is more rigid than an elastomer. Furthermore, provision is made in the drawings for regular spacing between the receptacles 10, 20, without the possibility of contact against the inner face of the external receptacle 20. However, in certain options nothing prevents for example providing localized axial areas of contact or guiding areas.

The invention claimed is:

1. A container for holding a product formed by mounting, along a longitudinal axis, an internal receptacle within an external receptacle, using a support flange, the container comprising:

the internal receptacle formed as one piece and delimiting an inner volume for receiving the product, the internal receptacle extending between a bottom and an upper face that is provided with an opening bordered by an annular upper end of the internal receptacle;

the external receptacle including a part made of non-deformable mineral material provided with a longitudinal opening and delimiting an interior volume accessible by the longitudinal opening, the external receptacle internally housing the internal receptacle within the interior volume; and a retaining interface for immobilizing the internal receptacle, the retaining interface comprising a support flange which is annular and integral with the external receptacle;

wherein the support flange is a lower flange of the retaining interface, said retaining interface also comprising an upper flange distinct from the support flange, the lower flange and the upper flange each delimiting a through-opening;

and wherein the external receptacle has an upper end provided with a removable attachment region for rendering the support flange integral with the upper end in an assembled configuration, in which:

the lower flange and the upper flange are sandwiching at least one engaging edge provided at or around the annular upper end in order to ensure the retention and immobilization of the internal receptacle, with the at least one engaging edge resting on an upper contact face of the lower flange and being pressed downwardly by the upper flange, in order to maintain space between the internal receptacle and the external receptacle in the assembled configuration, while the inner volume of the internal receptacle can be accessed via the through-opening of the upper flange; and the support flange is fixed in a position of axial overlap above the upper end, and allows detachable attachment of the upper flange in an engagement area that is offset radially outwards relative to an axial area of contact between the at least one engaging edge and the upper contact face.

2. The container according to claim 1, wherein the longitudinal opening is delimited by a neck of the external receptacle, the support flange being a part entirely external to the interior volume of the external receptacle and consisting essentially of:

a flat portion covering the neck axially; and an annular side portion for attachment to said neck.

3. The container according to claim 2, wherein the annular side portion extends downwards from an outer periphery of the flat portion and has at least one elastically deformable portion which is:

suitable for engaging with an annular peripheral attachment region formed on the neck and locking a coupling state of the support flange on the external receptacle, and delimited by slots or recesses in the thickness of the annular side portion.

4. The container according to claim 3, wherein the support flange comprises one or more rotation-locking members attached to the annular peripheral attachment region, in order to prevent rotation of the support flange around the external receptacle and to lock the coupling state, while being each formed in an inner engagement face, in the at least one elastically deformable portion.

5. The container according to claim 4, wherein the support flange is supporting the internal receptacle by the bottom and has external rotation-locking members capable of being attached on the upper flange in a locking configuration without interfering with the coupling state, in the knowledge that the external locking members are formed in one or more regions of the annular side portion which are distinct from the at least one elastically deformable portion, the external locking members being configured for maintaining a low axial clamping position of the upper flange while making it possible to clamp axially the at least one engaging edge between the lower flange and the upper flange by an action of relative rotation between the lower flange and the upper flange.

6. The container according to claim 4, wherein the upper flange forms a part that is selectively detachable from the support flange and defines a centering edge, the support flange being kept integral with the external receptacle by an attachment selected among a screw or a bayonet-type attachment, whereby the internal receptacle forms a refill that is extractable without radial friction against the retaining interface.

7. The container according to claim 3, wherein the upper flange forms a part that is selectively detachable from the support flange and defines a centering edge, the support flange being kept integral with the external receptacle by an attachment selected among a screw or a bayonet-type attachment, whereby the internal receptacle forms a refill that is extractable without radial friction against the retaining interface.

8. The container according to claim 2, wherein the upper flange forms a part that is selectively detachable from the support flange and defines a centering edge, the support flange being kept integral with the external receptacle by an attachment selected among a screw or a bayonet-type attachment, whereby the internal receptacle forms a refill that is extractable without radial friction against the retaining interface.

9. The container according to claim 1, wherein the internal receptacle is made of non-deformable rigid material, and the external receptacle is made of glass.

10. The container according to claim 1, wherein the internal receptacle has a longitudinal axis and an upper flange ring for forming the at least one engaging edge, the upper flange ring extending around an opening of the internal receptacle, and wherein the support flange projects radially inwards relative to an annular inner edge of the upper end, in order to reduce the cross-sectional area defined by the longitudinal opening of the external receptacle and allow the upper flange ring of the internal receptacle to be mounted directly from above on the support flange without placing the internal receptacle in contact with the external receptacle.

11. A method for assembling the container according to claim 1, by mounting an internal receptacle comprising or formed of a single piece of mineral material in an external receptacle made of non-deformable mineral material, the method comprising:

the coupling of a support flange which is annular around an upper end of the external receptacle, to obtain removable attachment of the support flange directly on the external receptacle;

the insertion of the single piece, which forms a product containing part of the internal receptacle, into an interior volume of the external receptacle through a longitudinal opening of the external receptacle and through a through-opening of the support flange, in a direction parallel to a longitudinal axis of the internal receptacle, until a pre-positioned configuration of the internal receptacle is obtained in which an annular upper end of the internal receptacle is bearing axially on an upper contact face that is part of the support flange, the formation of a retaining interface for immobilizing the internal receptacle, by coupling an upper flange that has a through-opening to the lower flange by axially clamping between the lower flange and the upper flange at least one engaging edge provided at the annular upper end, whereby the internal receptacle is held spaced apart from the external receptacle in an end position configuration, the through-opening of the upper flange allowing an inner volume of the internal receptacle to be accessed, while the upper flange remains coupled to the lower flange, the support flange being fixedly coupled in a position of axially overlapping the upper end of the external receptacle from above, while enabling a detachable attachment of the upper flange in an engagement area that is offset radially outwards relative to an axial area of contact between the at least one engaging edge and the upper contact face.

12. The method according to claim 11, wherein a centering of the internal receptacle within the external receptacle during formation of the retaining interface is carried out by:

an adjustment of position between an inner face of a side wall element included in the upper flange and an opposing wall of the support flange, said opposing wall being surrounded by the inner face; and a guiding by the upper flange of a follower projection formed on said annular upper end.

13. The container according to claim 1, wherein the internal receptacle is formed as a single piece, the at least one engaging edge being included in the annular upper end of the internal receptacle.

14. The container according to claim 1, wherein the upper flange is provided with a side wall element to surround the lower flange.

15. The container according to claim 1, wherein the upper flange is a piece of annular shape.

16. The container according to claim 1, wherein the upper flange is made as a single piece of molded plastic.

17. A container for holding a product formed by mounting, along a longitudinal axis, an internal receptacle within an external receptacle, using a support flange, the container comprising:

the internal receptacle formed as one piece and delimiting a volume for receiving the product, the internal receptacle extending between a bottom and an upper face that is provided with an opening bordered by an annular upper end of the internal receptacle;

the external receptacle including a part made of non-deformable mineral material provided with a longitudinal opening and delimiting an interior volume accessible by the longitudinal opening, the external receptacle internally housing the internal receptacle within the interior volume; and a retaining interface for immobilizing the internal receptacle, the retaining interface comprising a support flange which is annular and integral with the external receptacle;

wherein the support flange is a lower flange of the retaining interface, said retaining interface also comprising an upper flange distinct from the support flange, the lower flange and the upper flange each delimiting a through-opening;

and wherein the external receptacle has an upper end provided with a removable attachment region for rendering the support flange integral with the upper end in an assembled configuration, in which:

the lower flange and the upper flange are sandwiching at least one engaging edge provided at or around the annular upper end in order to ensure the retention and immobilization of the internal receptacle, with the at least one engaging edge resting on an upper contact face of the lower flange and being pressed downwardly by the upper flange, in order to maintain space between the internal receptacle and the external receptacle in the assembled configuration; and the support flange is fixed in a position of axial overlap above the upper end, and allows detachable attachment of the upper flange in an engagement area that is offset radially outwards relative to an axial area of contact between the at least one engaging edge and the upper contact face, wherein the lower flange and the upper flange are each made as a single piece of molded plastic.

18. A packaging unit comprising: a container provided with an external receptacle and an internal receptacle, the internal receptacle extending between a bottom and an upper face that is provided with an opening bordered by an annular upper end of the internal receptacle; and a lid which allows closing off the opening of the internal receptacle, wherein the container comprises a single-piece including a body of the internal receptacle, the single-piece delimiting a volume for receiving a product filled via the opening delimited by the single piece, the internal receptacle having an annular upper end extending around the opening;

a part of the external receptacle made of non-deformable mineral material, provided with a longitudinal opening and delimiting an interior volume of the external receptacle accessible by the longitudinal opening, the external receptacle internally housing the internal receptacle within the interior volume; and a retaining interface for immobilizing the internal receptacle, the retaining interface comprising a support flange which is annular and integral with the external receptacle;

wherein the support flange is a lower flange of the retaining interface, said retaining interface also comprising an upper flange distinct from the support flange, the lower flange delimiting a through-opening and the upper flange delimiting a through-opening;

wherein the external receptacle has a top end provided with a removable attachment region for rendering the support flange integral with the top end in an assembled configuration, in which:

the lower flange and the upper flange are sandwiching at least one radially protruding part provided at or around the annular upper end in order to ensure the retention and immobilization of the internal receptacle, with the at least one radially protruding part resting on an upper contact face of the lower flange and being pressed downwardly by the upper flange, so as to maintain space between the internal receptacle and the external receptacle; and the support flange is fixed in a position of axial overlap above the top end, and allows detachable attachment of the upper flange in an engagement area that is offset radially outwards relative to an axial area of contact between the at least one radially protruding part and the upper contact face, wherein in the assembled configuration, independently of the presence or absence of the lid to close the opening of the internal receptacle, the upper flange locks an axial position of the internal receptacle to immobilize the internal receptacle in a predetermined position relative to the external receptacle, wherein the lid has a side wall surrounding a peripheral outer side face of the retaining interface;

and wherein a side wall element of the upper flange defines said peripheral outer side face of the retaining interface and has an annular lower free edge facing an annular outer shoulder of the external receptacle.

19. The packaging unit according to claim 18, wherein at least one among the peripheral outer side face, an inner face of the annular end, and an outer face of the annular end, defines an annular area of contact with the lid, obtained by attaching the lid on the retaining interface.

20. The packaging unit according to claim 18, comprising an insertion gasket seal capable of being inserted inside the internal receptacle and forming a radial annular sealing contact against an inner face of the annular upper end, the insertion gasket seal being included in or made integral with the lid.

* * * * *